US008099031B2

(12) United States Patent
Kitagawa

(10) Patent No.: US 8,099,031 B2
(45) Date of Patent: Jan. 17, 2012

(54) IMAGE FORMING APPARATUS, TRANSFER UNIT THEREOF, AND METHOD OF SHIFTING TRANSFER ROLLERS THEREOF

(75) Inventor: Masaharu Kitagawa, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/972,309

(22) Filed: Dec. 17, 2010

(65) Prior Publication Data

US 2011/0085829 A1 Apr. 14, 2011

Related U.S. Application Data

(63) Continuation of application No. 12/840,101, filed on Jul. 20, 2010, now Pat. No. 7,877,048, which is a continuation of application No. 12/206,018, filed on Sep. 8, 2008, now Pat. No. 7,787,809.

(60) Provisional application No. 60/971,234, filed on Sep. 10, 2007.

(51) Int. Cl.
*G03G 15/01* (2006.01)

(52) U.S. Cl. ..... 399/299; 399/302

(58) Field of Classification Search ..... 399/121, 399/297, 298, 299, 300, 301, 302, 303, 304, 399/305, 306

See application file for complete search history.

(56) References Cited

U.S. PATENT DOCUMENTS

| | | | |
|---|---|---|---|
| 6,963,715 | B2 | 11/2005 | Kanekura et al. |
| 2002/0044799 | A1 | 4/2002 | Sasamoto et al. |
| 2007/0116496 | A1 | 5/2007 | Morimoto et al. |

FOREIGN PATENT DOCUMENTS

| | | |
|---|---|---|
| JP | 11-338220 | 12/1999 |
| JP | 2004-163795 | 6/2004 |
| JP | 2005-062642 | 3/2005 |

*Primary Examiner* — Mark R Gaworecki
(74) *Attorney, Agent, or Firm* — Patterson & Sheridan, LLP

(57) ABSTRACT

An image forming apparatus according to the present invention includes a first photoconductive member used during monochrome printing; a plurality of second photoconductive members used together with the first photoconductive member during full-color printing and arranged in parallel to the first photoconductive member; a transfer belt that forms a loop-like moving path; a first transfer roller and a plurality of second transfer rollers provided on an inner peripheral side of the transfer belt; and a link member that shifts, during the full-color printing, the second transfer rollers to positions where the second transfer rollers are brought into press contact with the respective second photoconductive members via the transfer belt and shifts, during the monochrome printing, the second transfer rollers to positions where respective separations between an inner peripheral surface of the transfer belt and the respective second transfer rollers are substantially identical.

9 Claims, 11 Drawing Sheets

RELATED ART

IMAGE FORMING APPARATUS, TRANSFER UNIT THEREOF, AND METHOD OF SHIFTING TRANSFER ROLLERS THEREOF

CROSS-REFERENCE TO RELATED APPLICATIONS

This application is a continuation of co-pending U.S. patent application Ser. No. 12/840,101, filed Jul. 20, 2010 which is a continuation of U.S. Ser. No. 12/206,018, filed Sep. 8, 2008, now U.S. Pat. No. 7,787,809, issued Aug. 31, 2008, which claims benefit of U.S. Provisional Patent Application Ser. No. 60/971,234, filed Sep. 10, 2007. Each of the aforementioned related patent applications is herein incorporated by reference.

BACKGROUND OF THE INVENTION

1. Technical Field

The present invention relates to an image forming apparatus, a transfer unit thereof, and a method of shifting transfer rollers thereof, and, more particularly to a tandem image forming apparatus that can perform color printing, a transfer unit thereof, and a method of shifting transfer rollers thereof.

2. Background

Conventionally, in image forming apparatuses that can perform color printing such as a copying machine, a printer, and a multi-functional peripheral (MFP), an electrophotographic system called tandem type is widely used.

In an image forming apparatus of a tandem electrophotographic system, four photoconductive drums corresponding to respective colors of yellow (Y), magenta (M), cyan (C), and black (K) are arrayed along an intermediate transfer belt. Images of the respective colors of Y, M, C, and K are transferred from the respective photoconductive drums onto an intermediate transfer belt to be superimposed one on top of another. A full-color image is formed on the intermediate transfer belt. This full-color image is further transferred onto a sheet and a full-color image is formed on the sheet.

The transfer of the images from the respective photoconductive drums onto the intermediate transfer belt is performed by using four transfer rollers provided for the respective colors of Y, M, C, and K. The four transfer rollers are arrayed in positions opposed to the photoconductive drums for the respective colors across the intermediate transfer belt.

In general, an image forming apparatus that can perform color printing has two printing modes, i.e., a full-color printing mode for forming a full-color image and a monochrome printing mode for forming a monochrome (black and white) image.

As disclosed in JP-A 2004-163795 and so on, in the full-color printing mode, the four transfer rollers are shifted to positions where the transfer rollers are brought into press contact with the photoconductive drums for the corresponding colors via the intermediate transfer belt (hereinafter, press-contact position). On the other hand, in the monochrome printing mode, the three transfer rollers for Y, M, and C are shifted to positions where the transfer rollers are separated from the photoconductive drums of the corresponding colors and the intermediate transfer belt (hereinafter, separated position). As a result, components unnecessary in the monochrome printing mode relatively frequently used, i.e., the respective transfer rollers and the respective photoconductive drums for Y, M, and C do not physically come into contact with the intermediate transfer belt, and thus it is possible to extend the life of these components and improve reliability thereof.

The image forming apparatus can switch the full-color printing mode and the monochrome printing mode according to setting by a user. The image forming apparatus can also automatically switch the full-color printing mode and the monochrome printing mode by distinguishing whether an original is a color original or a monochrome original. In the case of the automatic switching, the full-color printing mode and the monochrome printing mode are likely to be frequently switched depending on a type of an original. Therefore, it is necessary to shift the three transfer rollers for Y, M, and C between the press-contact position and the separating position in a short time.

On the other hand, if a driving force is set too large in order to shift the transfer rollers between the press-contact position and the separating position in a short time, power necessary for driving increases. Moreover, impact involved in shifting and stopping of the transfer rollers increases, which causes noise and wear of components.

SUMMARY

The present invention has been devised in view of the circumstances described above and it is an object of the present invention to provide an image forming apparatus, a transfer unit thereof, and a method of shifting transfer rollers thereof that can switch, in a short time, positions of transfer rollers in a full-color printing mode and positions of the transfer rollers in a monochrome printing mode and can reduce impact and noise involved in the switching.

In order to attain the object, an image forming apparatus according to an aspect of the present invention includes a first photoconductive member used during monochrome printing, plural second photoconductive members used together with the first photoconductive member during full-color printing and arranged in parallel to the first photoconductive member, a transfer belt that forms a loop-like moving path and onto an outer peripheral surface of which a toner image formed on the first photoconductive member is transferred during the monochrome printing and toner images formed on the first photoconductive member and the respective second photoconductive members are transferred during the full-color printing, a first transfer roller and plural second transfer rollers provided on an inner peripheral side of the transfer belt and respectively arranged in positions opposed to the first photoconductive member and the second photoconductive members, and a link member that shifts, during the full-color printing, the plural second transfer rollers to positions where the second transfer rollers are brought into press contact with the respective second photoconductive members via the transfer belt and shifts, during the monochrome printing, the second transfer rollers to positions where respective separations between an inner peripheral surface of the transfer belt and the respective second transfer rollers are substantially identical.

A transfer unit according to another aspect of the present invention includes a transfer belt that forms a loop-like moving path and onto an outer peripheral surface of which only a toner image formed on a first photoconductive member is transferred during monochrome printing and toner images formed on plural second photoconductive members arranged in parallel to the first photoconductive member and on the first photoconductive member are transferred during full-color printing, a first transfer roller and plural second transfer rollers provided on an inner peripheral side of the transfer belt and respectively arranged in positions opposed to the first photoconductive member and the second photoconductive members, and a link member that shifts, during the full-color printing, the plural second transfer rollers to positions where the second transfer rollers are brought into press contact with the respective second photoconductive members via the transfer belt and shifts, during the monochrome printing, the second transfer rollers to positions where respective separations between an inner peripheral surface of the transfer belt and the respective second transfer rollers are substantially identical.

A method of shifting transfer rollers according to still another aspect of the present invention includes transferring, during monochrome printing, only a toner image formed on a first photoconductive member onto an outer peripheral surface of a transfer belt forming a loop-like moving path and transferring, during full-color printing, toner images formed on plural second photoconductive members arranged in parallel to the first photoconductive member and on the first photoconductive member onto the outer peripheral surface, and shifting, during the full-color printing, plural second transfer rollers provided on an inner peripheral side of the transfer belt and respectively arranged in positions opposed to the second photoconductive members to positions where the second transfer rollers are brought into press contact with the respective second photoconductive members via the transfer belt and shifting, during the monochrome printing, the second transfer rollers to positions where respective separations between an inner peripheral surface of the transfer belt and the respective second transfer rollers are substantially identical.

DESCRIPTION OF THE DRAWINGS

In the accompanying drawings.

DETAILED DESCRIPTION

An image forming apparatus, a transfer unit thereof, and a method of shifting transfer rollers thereof according to embodiments of the present invention are explained below with reference to the accompanying drawings.

(1) Image Forming Apparatus

Figure 1:
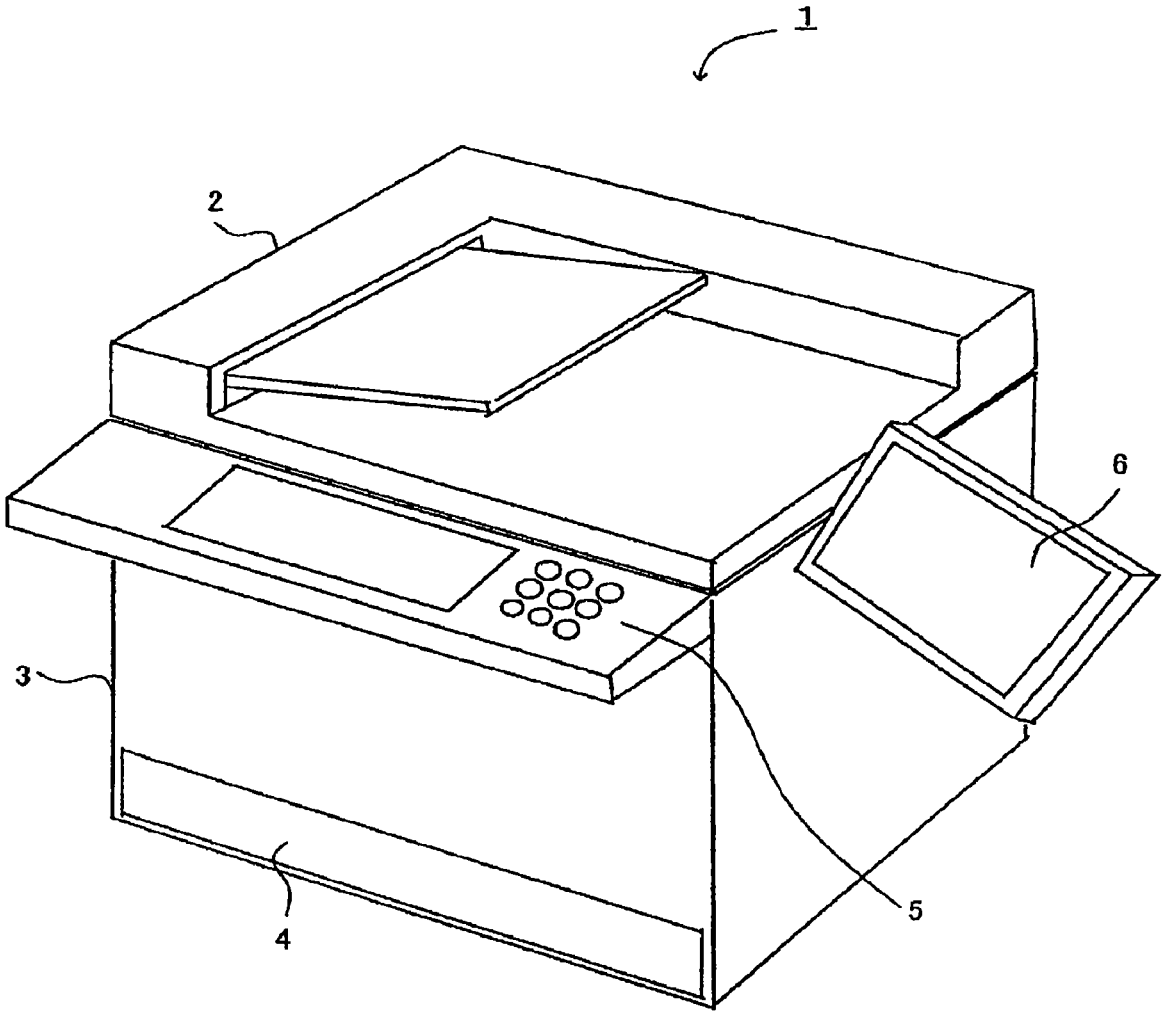
FIG. 1 is a perspective view showing an example of an appearance of an image forming apparatus according to an aspect of the present invention.

FIG. 1 is a diagram showing an example of an appearance of a copying machine (or an MFP) as a typical example of an image forming apparatus 1 according to this embodiment.

The image forming apparatus 1 includes a scanning unit 2, an image forming unit 3, a paper feeding unit 4 and the like.

The scanning unit 2 optically scans an original placed on an original stand or an original inserted into an ADF (Auto Document Feeder) and generates image data.

The image forming unit 3 prints the image data on a sheet fed from the paper feeding unit 4 using an electrophotographic system. A control panel 5 for a user to perform various kinds of operation and a display panel 6 on which various kinds of information are displayed are provided in the image forming unit 3.

Figure 2:
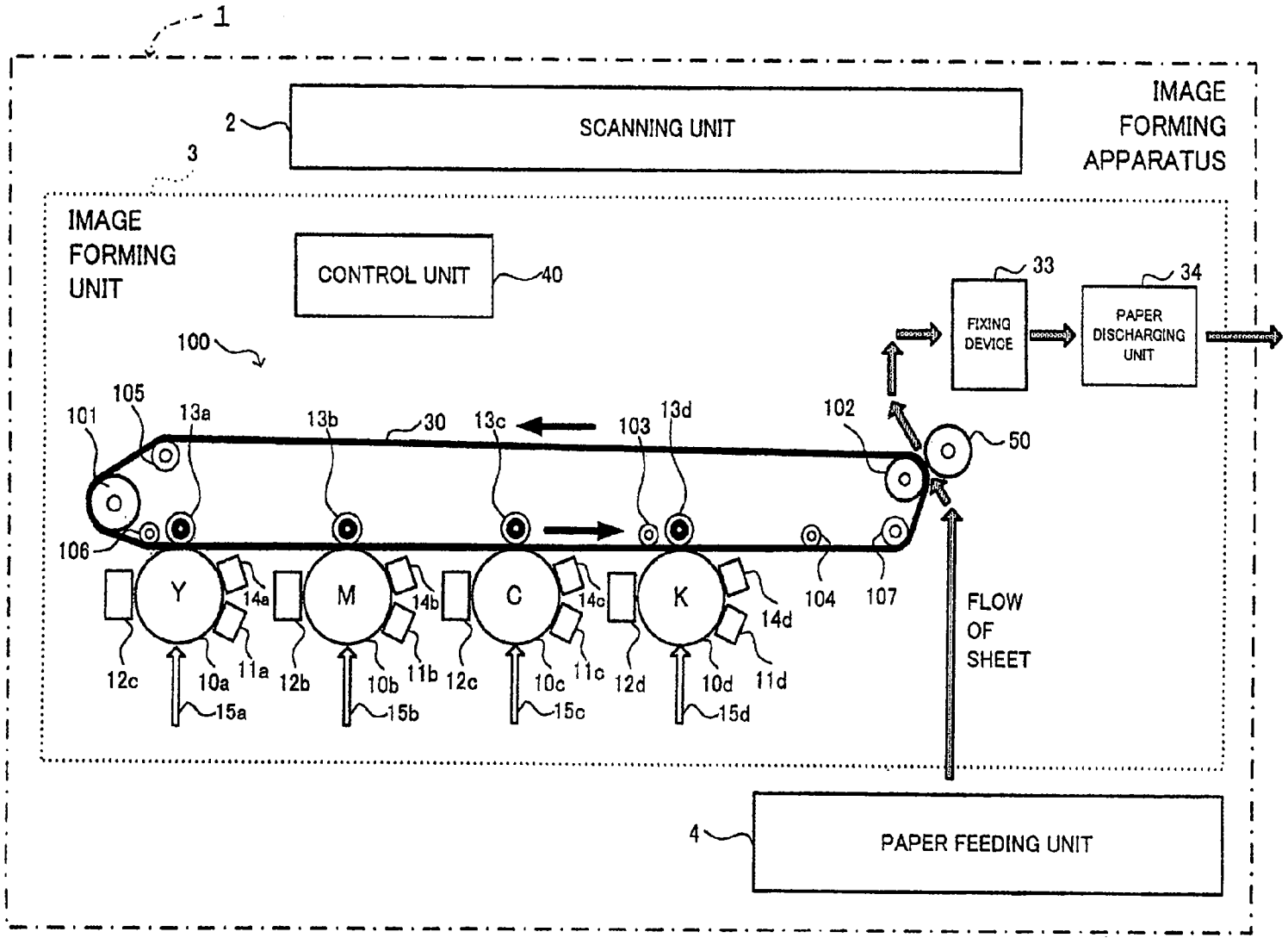
FIG. 2 is a sectional view showing an example of a configuration of the image forming apparatus according to the aspect of the present invention.

FIG. 2 is a schematic sectional view mainly showing an example of an internal configuration of the image forming unit 3. The image forming apparatus 1 according to this embodiment is configured to be capable of performing color printing according to a tandem electrophotographic system.

As shown in FIG. 2, four photoconductive drums 10*a* to 10*d* corresponding to four colors of yellow (Y), magenta (M), cyan (C), and black (K) are disposed in parallel along a conveying direction of a transfer belt (an intermediate transfer belt) 30. Around the respective photoconductive drums 10, charging devices 11*a* to 11*d*, developing devices 12*a* to 12*d*, transfer rollers (primary transfer rollers) 13*a* to 13*d*, cleaners 14*a* to 14*d*, and the like are disposed in order from upstream to downstream of the rotation of the photoconductive drums 10, respectively. The alphabets a, b, c, and d attached to the reference numerals of the components described above correspond to the printing colors Y, M, C, and K, respectively.

The surfaces of the respective photoconductive drums 10*a* to 10*d* are uniformly charged to predetermined potential by the charging devices 11*a* to 11*d*. Thereafter, laser beams 15*a* to 15*d* subjected to pulse-width modulation according to levels of image data of the respective colors of Y, M, C, and K are irradiated on the surfaces of the photoconductive drums 10*a* to 10*d* for the respective colors. When the laser beams 15*a* to 15*d* are irradiated, the potential in portions where by laser beams are irradiated fall. Electrostatic latent images are formed on the surfaces of the photoconductive drums 10*a* to 10*d*.

The developing devices 12*a* to 12*d* develop the electrostatic latent images on the respective photoconductive drums 10*a* to 10*d* with toners corresponding to the respective colors. According to the development, toner images of the respective colors of Y, M, C, and K are formed on the respective photoconductive drums 10*a* to 10*d*.

The transfer belt 30 is laid over a driving roller 101 and a secondary transfer counter roller 102 in a loop shape and continuously rotated in a direction of an arrow shown in the figure by the driving of the driving roller 101.

While the transfer belt 30 passes respective nip sections formed by the photoconductive drums 10*a* to 10*d* and the transfer rollers 13*a* to 13*d*, the toner images of the respective colors of Y, M, C, and K are sequentially transferred onto an outer peripheral surface of the transfer belt 30.

First, the Y toner image is transferred from the photoconductive drum 10*a* onto the transfer belt 30 in a position where the photoconductive drum 10*a* for Y and the transfer roller 13*a* for Y are opposed to each other (a transfer position for Y).

Subsequently, the M toner image is transferred from the photoconductive drum 10*b* onto the transfer belt 30 in a position where the photoconductive drum 10*b* for M and the transfer roller 13*b* for M are opposed to each other (a transfer position for M). At this point, the M toner image is transferred to be superimposed on the Y toner image already transferred on the outer peripheral surface of the transfer belt 30.

Thereafter, in the same manner, the C toner image and the K toner image are sequentially transferred to be superimposed on the toner images on the outer peripheral surface of the transfer belt 30. Consequently, a full-color toner image is formed on the transfer belt 30. This full-color toner image is carried to a nip section (a secondary transfer position) formed by a secondary transfer roller 50 and the secondary transfer counter roller 102 according to the movement of the transfer belt 30.

A sheet picked up from the paper feeding unit 4 is conveyed to the secondary transfer position by not-shown conveying means. In this secondary transfer position, the full-color toner image on the transfer belt 30 is transferred onto the sheet. The full-color toner image is heated and pressed and fixed on the sheet by the fixing device 33. Thereafter, the sheet is discharged to the outside of the image forming apparatus 1 by a paper discharging unit 34.

On the respective photoconductive drums 10*a* to 10*d* from which the transfer of the toner images to the transfer belt 30 is finished, the toners remaining on the surfaces thereof are removed by cleaners 14*a* to 14*d*. The photoconductive drums 10*a* to 10*d* are prepared for printing of the next sheet. Continuous full-color printing can be performed by repeating the processing described above.

On the other hand, when monochrome printing is performed, the K toner image is transferred onto the transfer belt 30 by only the photoconductive drum 10*d* for K (a first photoconductive member) and the transfer roller 13*d* for K (a first transfer roller). The photoconductive drums 10*a* to 10*c* for Y, M, and C (second photoconductive members) and the transfer rollers 13*a* to 13*c* for Y, M, and C (second transfer rollers) are not used.

Therefore, during the monochrome printing, the photoconductive drums 10*a* to 10*c* and the transfer rollers 13*a* to 13*c* for Y, M, and C are physically separated from the transfer belt 30 to prevent abrasion of these components and obtain a longer period of endurance.

Specifically, the transfer belt 30 and the photoconductive drums 10*a* to 10*c* are separated by lifting on the driving roller 101 side and inclining the transfer belt 30. Moreover, the transfer rollers 13*a* to 13*c* are shifted in a direction away from the photoconductive drums 10*a* to 10*c* (an upward direction in FIG. 2) to separate the transfer rollers 13*a* to 13*c* and the transfer belt 30.

A control unit 40 of the image forming unit 3 performs control of the entire image forming apparatus 1. The control unit 40 also performs control for changing from a full-color printing mode (an operation mode for performing the full-color printing) to a monochrome printing mode (an operation mode for performing the monochrome printing) (or inversely changing from the monochrome printing mode to the full-color printing mode).

(2) Transfer Unit

The transfer belt 30 and the transfer rollers 13*a* to 13*c* are components of the transfer unit 100. A shift of the transfer rollers 13*a* to 13*c* is performed by the transfer unit 100, following the mode changing between the full-color printing mode and the monochrome printing mode. The structure and operations of the transfer unit 100 are explained in detail below.

Figure 3:
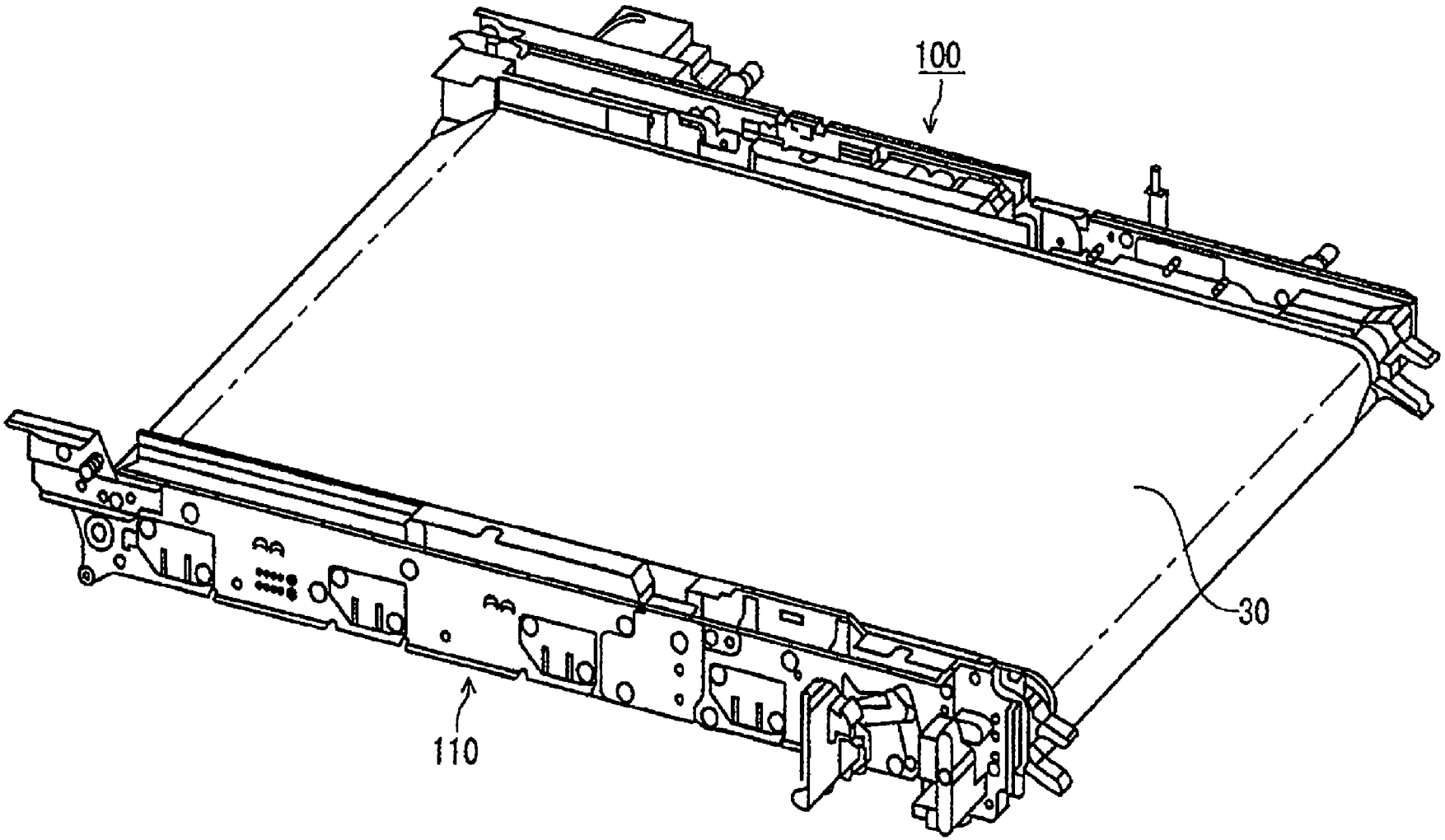
FIG. 3 is a perspective view showing an example of an appearance of a transfer unit according to the aspect of the present invention.

FIG. 3 is a perspective view showing an example of an appearance of the transfer unit 100. The transfer unit 100 incorporates the transfer rollers 13*a* to 13*d*, the driving roller 101, the secondary transfer counter roller 102, and the like. The transfer belt 30 covers the periphery of the transfer unit 100 in a loop shape. The respective rollers incorporated in the transfer unit 100 are supported by a frame 110 at both ends thereof.

Figure 4:
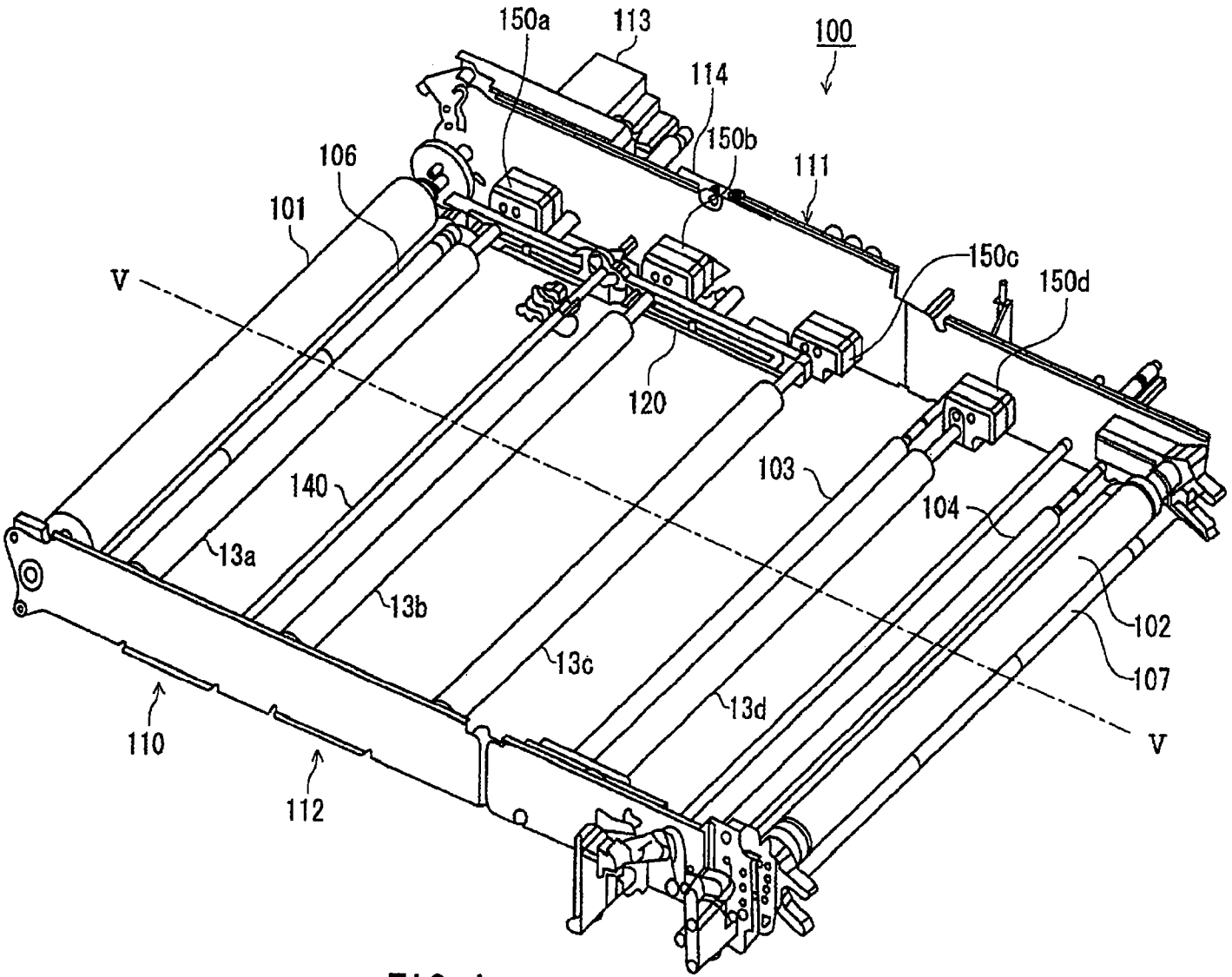
FIG. 4 is a perspective view showing an example of a configuration of the transfer unit from which a transfer belt is removed.
Figure 5:
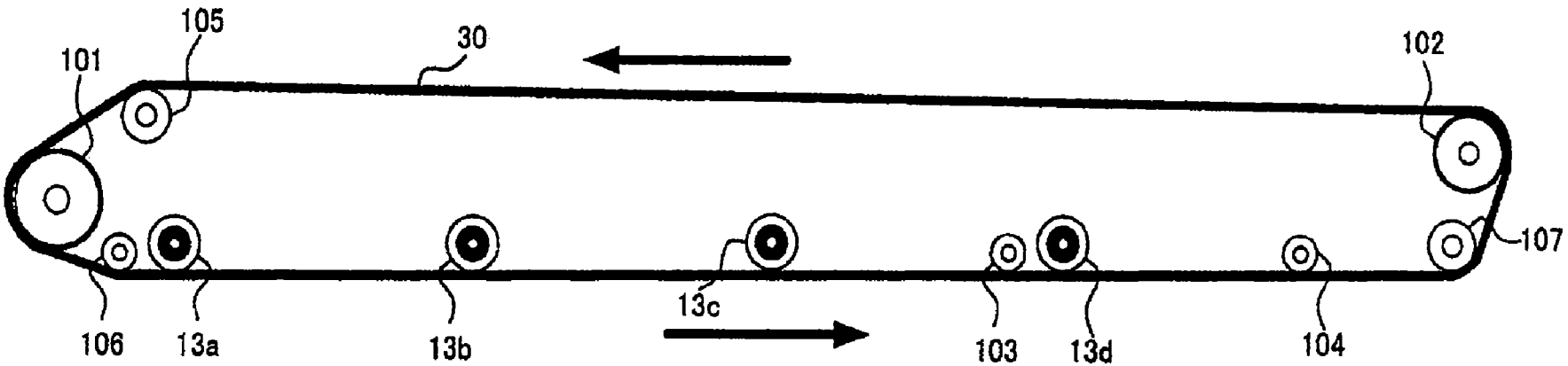
FIG. 5 is a sectional view showing an example of a configuration of the transfer unit.

FIG. 4 is a perspective view showing an example of an appearance of the transfer unit 100 from which the transfer belt 30 is removed. The arrangement of various rollers and the supporting structure therefor are schematically shown in the figure. FIG. 5 is a sectional view of the transfer unit 100 taken along line V-V in FIG. 4.

In the transfer unit 100, along a conveying direction of the transfer belt 30 from a left end in FIG. 5, the driving roller 101, a lift roller 106, the transfer roller (for Y) 13*a*, the transfer roller (for M) 13*b*, the transfer roller (for C) 13*c*, a fixed roller 103, the transfer roller (for K) 13*d*, a fixed roller 104, a fixed roller 107, the secondary transfer counter roller 102, and a tension roller 105 (not shown in FIG. 4) are arrayed. Both ends of rotary shafts of the respective rollers are supported by a rear assembly 111 and a front assembly 112, which are components of the frame 110. The driving roller 101 is rotated by a belt driving motor 113 (see FIG. 4) and drives the transfer belt 30.

The tension roller 105 is urged in an upward direction in FIG. 5 by a not-shown elastic member. The tension roller 105 applies tension to the transfer belt 30 to prevent the transfer belt 30 from loosening. The lift roller 106 is also urged in the upward direction in FIG. 5 by the not-shown elastic member.

The secondary transfer counter roller 102 is a driven roller provided on the opposite side of the driving roller 101. The secondary transfer counter roller 102 secondarily transfers a toner image formed on the transfer belt 30 onto a sheet in the nip section formed between the secondary transfer counter roller 102 and the secondary transfer roller 50 (see FIG. 2).

The fixed rollers 103, 104, and 107 are provided for a main purpose of regulating a position of a lower surface (a surface opposed to the photoconductive drums 10*a* to 10*d*) of the transfer belt 30. The fixed rollers 103, 104, and 107 are rotatably supported axially. However, positions of the shafts thereof are always fixed regardless of an operation mode.

One sides of the shafts of the four transfer rollers 13*a*, 13*b*, 13*c*, and 13*d* are respectively supported by four roller supporting units 150*a*, 150*b*, 150*c*, and 150*d* fixed to the rear assembly 111. The other sides of the shafts are respectively supported by four roller supporting units 151*a*, 151*b*, 151*c*, and 151*d* (see FIG. 7; the roller supporting unit 151*d* is not shown in the figure) fixed to the front assembly 112.

The roller supporting units 150*a* to 150*d* and 151*a* to 151*d* rotatably support the respective shafts of the transfer rollers 13*a* to 13*d*. The roller supporting units 150*a* to 150*d* and 151*a* to 151*d* restrain positions of the respective shafts of the transfer rollers 13*a* to 13*d* in a left to right direction in FIG. 5 (in the following explanation, the left to right direction means an array direction of the photoconductive drums 10*a* to 10*d*, i.e., a conveying direction and a conveying reverse direction of the transfer belt 30). On the other hand, The roller supporting units 150*a* to 150*d* and 151*a* to 151*d* allow the respective shafts to move in an up to down direction (in the following explanation, the up to down direction means a direction in which the transfer rollers 13*a* to 13*d* approach and separate from the photoconductive drums 10*a* to 10*d*). Moreover, the roller supporting units 150*a* to 150*d* and 151*a* to 151*d* urge the respective shafts of the transfer rollers 13*a* to 13*d* downward (in a direction in which the transfer rollers 13*a* to 13*d* approach the photoconductive drums 10*a* to 10*d*) with elastic members such as push springs incorporated therein.

In this way, the respective shafts of the transfer rollers 13*a* to 13*d* are configured to be movable in the up to down direction. According to functions of link members 120 and 121 and the like described later, in the full-color printing mode, the transfer rollers 13*a* to 13*c* for Y, M, and C shift downward and come into press contact with the photoconductive drums 10*a* to 10*c* for Y, M, and C via the transfer belt 30. On the other hand, in the monochrome printing mode, the transfer rollers 13*a* to 13*c* for Y, M, and C shift upward and separate from the photoconductive drums 10*a* to 10*c* for Y, M, and C and the transfer belt 30.

The transfer roller 13*d* for K is also movable in the up to down direction. However, the functions of the link members 120 and 121 and the like are not caused to act on the transfer roller 13*d*. The position of the shaft of the transfer roller 13*d* for K, therefore, does not change in the full-color printing mode and the monochrome printing mode.

Figure 6:
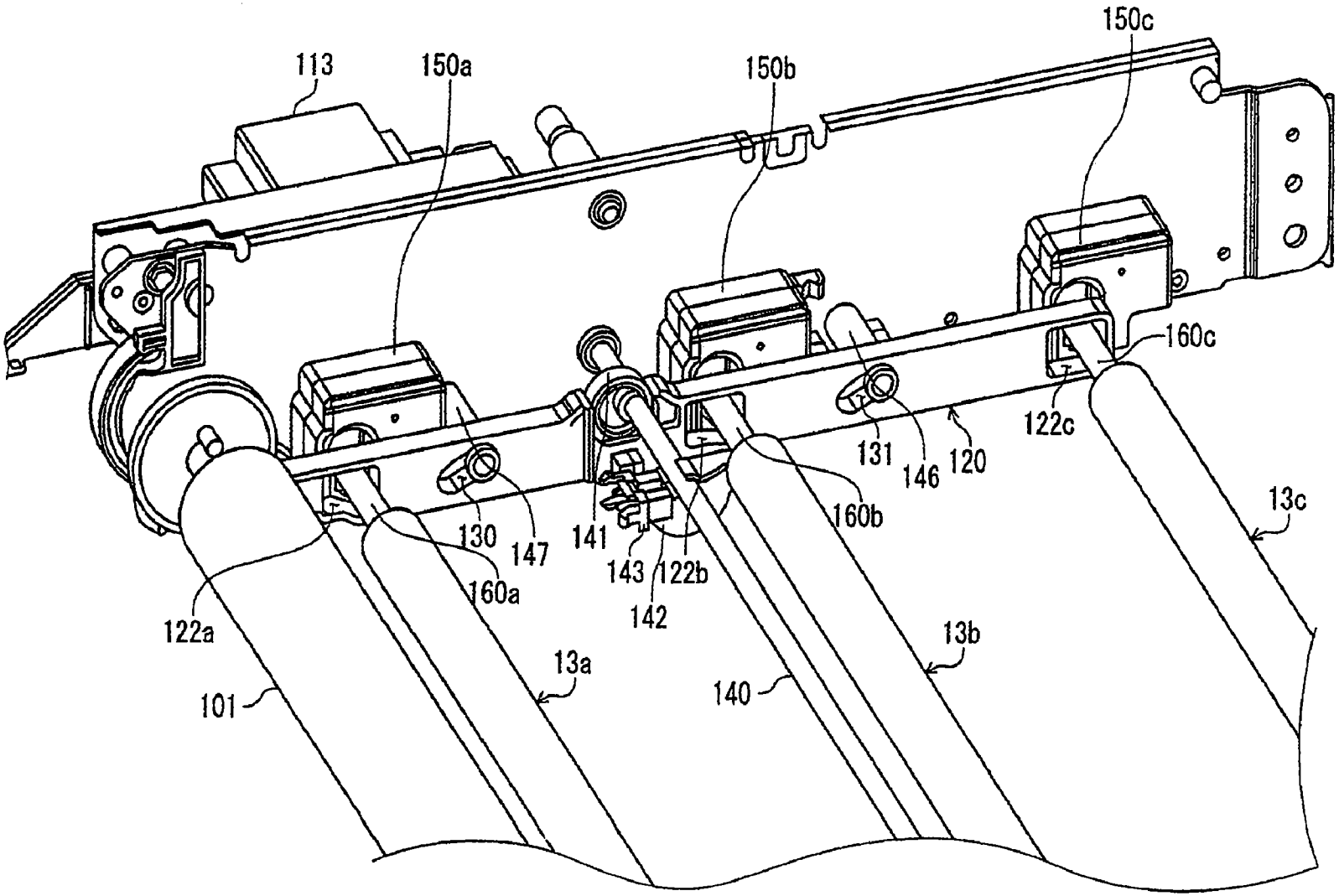
FIG. 6 is a first perspective view showing an example of the structure for attaching transfer rollers for Y, M, and C.
Figure 8:
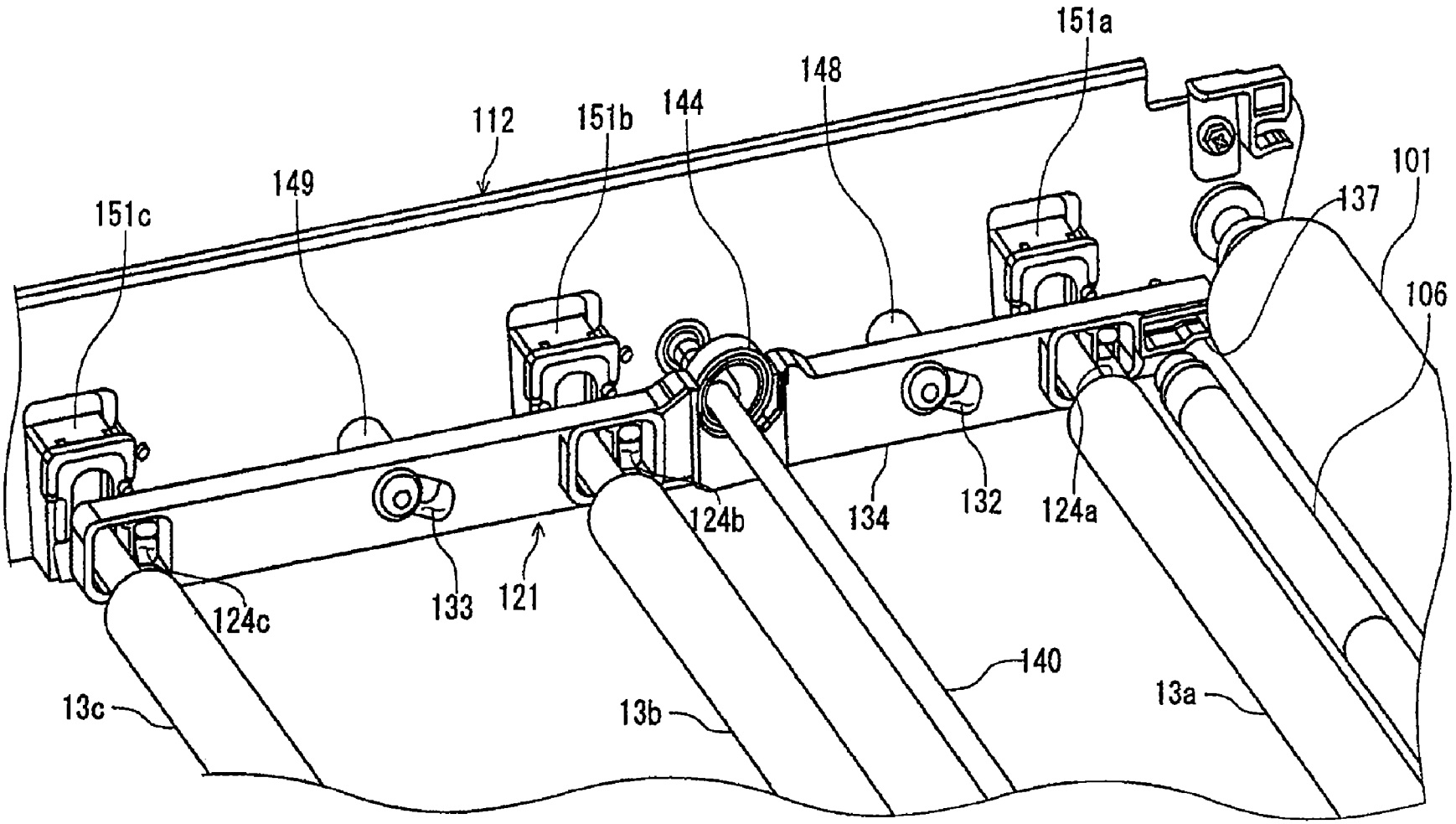
FIG. 8 is a second perspective view showing an example of the structure for attaching the transfer rollers for Y, M, and C.

FIG. 6 is an enlarged perspective view of the supporting structure for the transfer rollers 13*a* to 13*c* for Y, M, and C on the rear assembly 111 side. FIG. 8 is an enlarged perspective view of the supporting structure for the transfer rollers 13*a* to 13*c* for Y, M, and C on the front assembly 112 side.

As shown in FIG. 6, a link member 120 slender in a left to right direction is disposed between the transfer rollers 13*a* to 13*c* for Y, M, and C and the roller supporting units 150*a* to 150*c* on the rear assembly 111 side.

Figure 7:
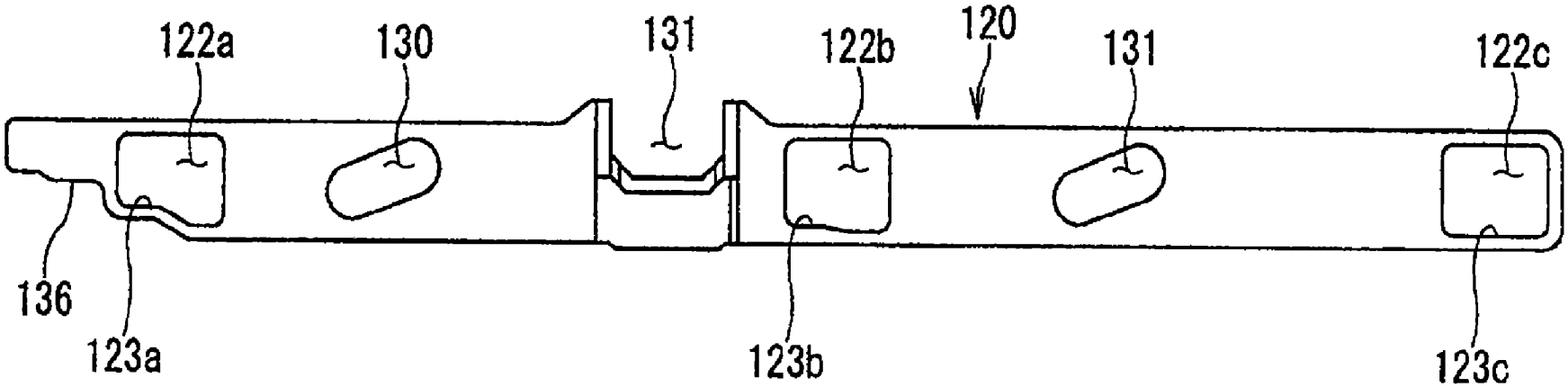
FIG. 7 is a diagram showing an example of an appearance of a link member.

FIG. 7 is a diagram showing a shape and the structure of the link member 120. In the link member 120, through holes 122*a*, 122*b*, and 122*c* through which a roller shaft 160*a* of the transfer roller 13*a* for Y, a roller shaft 160*b* of the transfer roller 13*b* for M, and a roller shaft 160*b* of the transfer roller 13*c* for C penetrate are formed, respectively.

The roller shafts 160*a* to 160*c* are urged in the downward direction by the roller supporting units 150*a* to 150*c*, respectively, as described above. The roller shafts 160*a* to 160*c* are brought into contact with lower surfaces of the through holes 122*a*, 122*b*, and 122*c*, respectively, by this urging force and supported in a state urged downward. The lower surfaces of the through holes 122*a*, 122*b*, and 122*c* are hereinafter referred to as a contact surface 123*a*, a contact surface 123*b*, and a contact surface 123*c*, respectively.

The respective contact surfaces 123*a*, 123*b*, and 123*c* for Y, M, and C are formed in shapes different from one another. The contact surface 123*c* for C is formed in a flat shape. In the contact surfaces 123*a* and 123*b* for Y and M, steps are formed. Sizes of the steps are different in the contact surfaces 123*a* and 123*b* for Y and M.

A distal end contact surface 136, a lower surface of which has a step, is formed in a distal end section on a left side of the link member 120. The lift roller 106 urged in the upward direction comes into contact with the distal end contact surface 136.

Operations and effects due to the difference in the shapes of the respective contact surfaces 123*a*, 123*b*, and 123*c* for Y, M, and C and operations and effects of the contact surface 133 for the lift roller are described later.

A cutout section 131 opened in the upward direction is formed in the center of the link member 120. As shown in FIG. 6, a circular eccentric cam 141 is inserted in the cutout section 131 to be rotatable around an eccentric axis thereof. A separating and approaching shaft 140 is axially fixed to the eccentric axis. The eccentric cam 141 is eccentrically rotated in the cutout section 131 by the rotation of the separating and approaching shaft 140.

The separating and approaching shaft 140 is rotated in a forward direction and a reverse direction by a separation and approach driving motor 114. Rotation control (switching of a direction of the rotation, start of the rotation, timing for stopping the rotation, etc.) for the separating and approaching shaft 140 is performed by a semicircular shielding plate 142 fixed to the separating and approaching shaft 140 by detecting timing for blocking and opening an optical path in a photosensor 143.

Inclined long holes 130 and 131 are formed on both sides of the cutout section 131. Columnar link guide members 146 and 147 are fixed to the frame 110 (the rear assembly 111). The link guide members 146 and 147 are inserted through the inclined long holes 130 and 131 and can slide along the inclination of the inclined long holes 130 and 131.

On the other hand, as shown in FIG. 8, components substantially the same as those on the rear assembly 111 side are disposed on the front assembly 112 side. A link member 121 forming a pair with the link member 120 is disposed between the transfer rollers 13*a* to 13*c* for Y, M, and C and the roller supporting units 151*a* to 151*c* on the front assembly 112 side. In the link member 121, through holes 124*a* to 124*c*, a cutout section 134, inclined long holes 132 and 133, and a distal end contact surface 137 having shapes same as those of the link members 120 are formed. The other ends of the roller shafts of the transfer rollers 13*a* to 13*c* are inserted through the through holes 124*a* to 124*c*. An eccentric cam 144 forming a pair with the eccentric cam 141 on the rear assembly 111 side is inserted in the cutout section 134. Similarly, link guide members 148 and 149 forming pairs with the link guide members 146 and 147 on the rear assembly 111 side are slidably inserted through the inclined long holes 132 and 133.

(3) Shift of Positions of the Transfer Rollers

In the image forming apparatus 1 and the intermediate transfer unit 100 according to this embodiment, the three transfer rollers 13*a* to 13*c* for Y, M, and C are shifted in the up to down direction to change positions thereof in the full-color printing mode and the monochrome printing mode. This embodiment is characterized by a method of shifting the transfer rollers 13*a* to 13*c*.

A method of shifting the three transfer rollers 13*a* to 13*c* for Y, M, and C is explained below with reference to FIGS. 9A and 9B and FIGS. 10A and 10B. FIGS. 10A and 10B are diagrams for facilitating explanation. The shape of the through holes 122*a* to 122*c* in FIGS. 10A and 10B is intentionally exaggeratedly deformed. Further, the cutout section 131 and the inclined long holes 130 and 131 are omitted in FIGS. 10A and 10B.

The rear assembly 111 side and the front assembly 112 side are symmetrically configured. Therefore, in the following explanation, the components on the rear assembly 111 side are used.

Figures 9A, 9B:
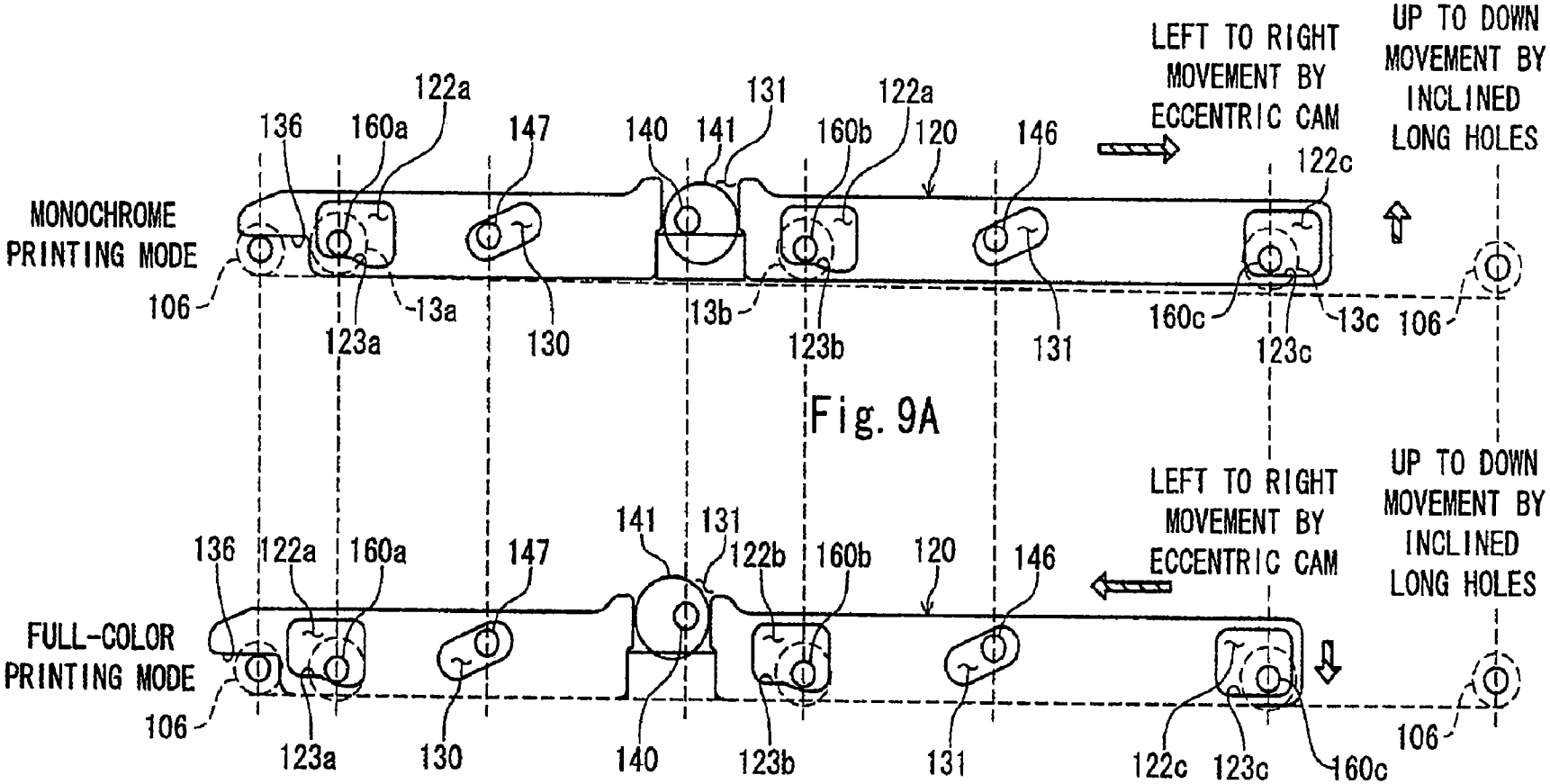
FIGS. 9A and 9B are first explanatory views of a shifting operation for the transfer rollers for Y, M, and C.
Figure 10A:
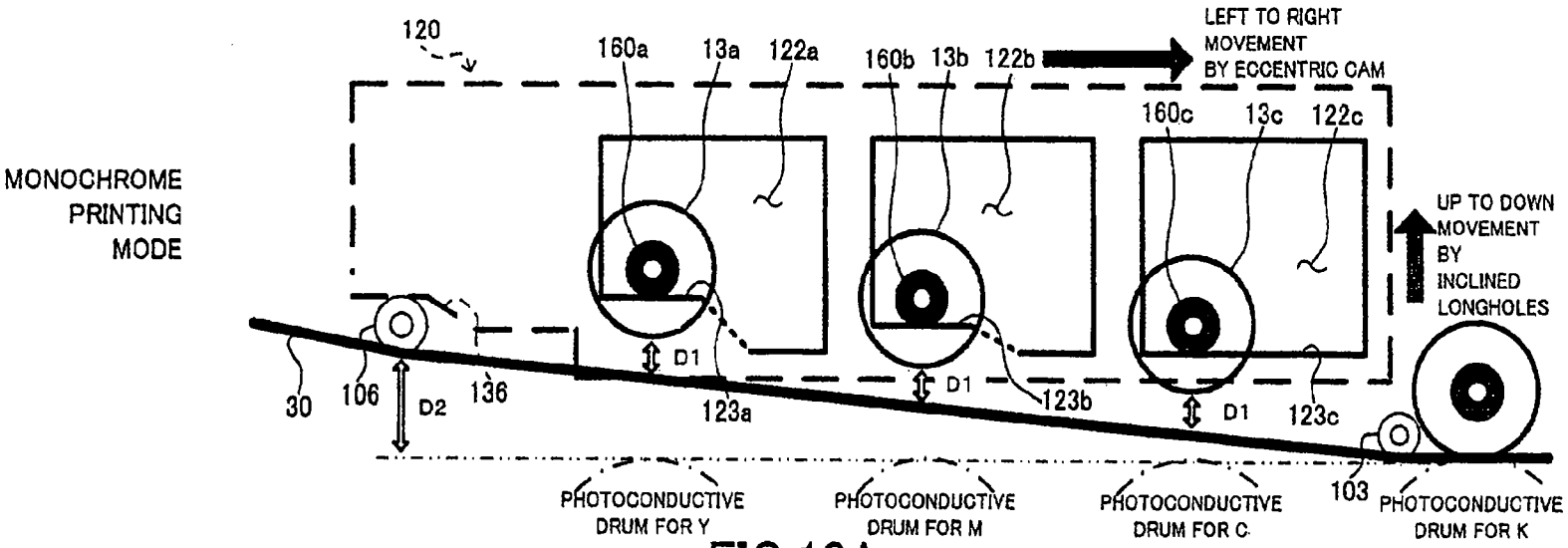
FIGS. 10A and 10B are second explanatory diagrams of the moving operation for the transfer rollers for Y, M, and C.
Figure 10B:
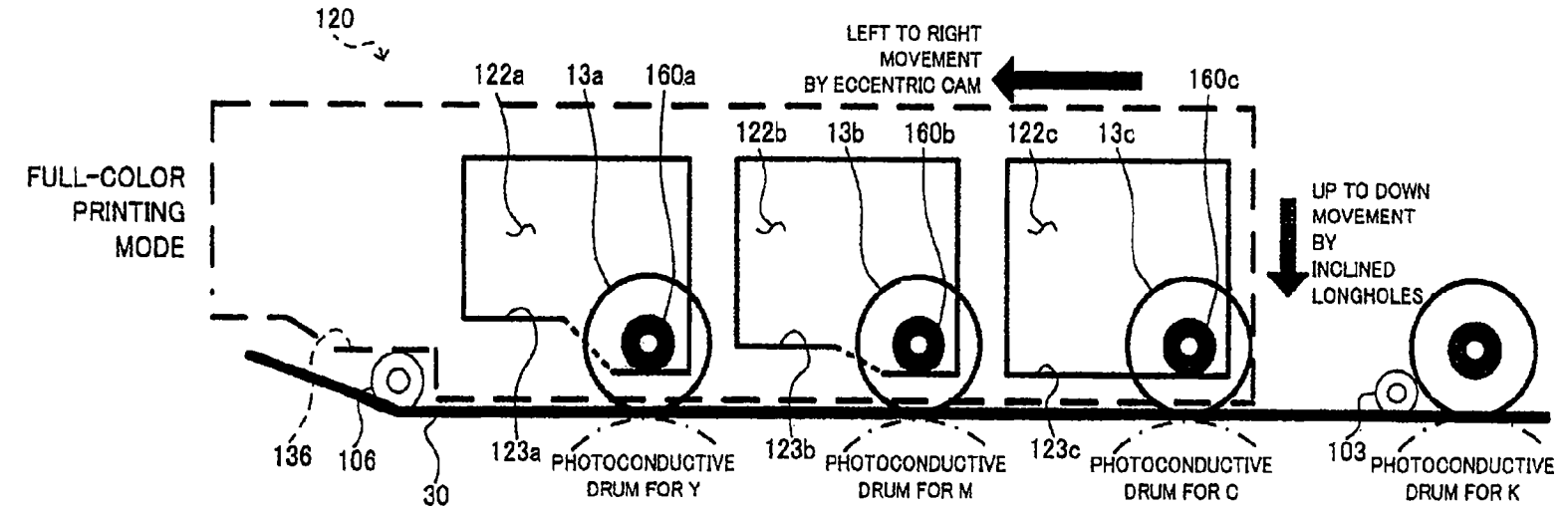

FIG. 9A is a diagram corresponding to the monochrome printing mode and FIG. 9B is a diagram corresponding to the full-color printing mode. Similarly, FIG. 10A is a diagram corresponding to the monochrome printing mode and FIG. 10B is a diagram corresponding to the full-color printing mode.

First, motions of the link member 120 are explained with reference to FIGS. 9A and 9B. As explained above, the link member 120 is supported to be slidable in the inclined direction by the link guide members 146 and 147 inserted through the two inclined long holes 130 and 131, while the eccentric cam 141 inserted in the cutout section 131 is eccentrically rotated by the separating and approaching shaft 140.

In the monochrome printing mode (FIG. 9A), the eccentric axis of the eccentric cam 141 is stopped in a position relatively eccentric to the left side. On the other hand, in the full-color mode (FIG. 9B), the eccentric axis of the eccentric cam 141 is changed to a position relatively eccentric to the right side by the rotation of the separating and approaching shaft 140. An absolute position of the eccentric axis is a position of the separating and approaching shaft 140 axially supported by the frame 110 and does not change in the left to right direction. Therefore, the link member 120 horizontally moves in the left to right direction with respect to the frame 110 according to a motion of the rotation of the eccentric cam 141. This results in that the link member 120 moves to the right side in the monochrome printing mode and moves to the left side in the full-color printing mode.

Meanwhile, the link guide members 146 and 147 fixed to the frame 110 slide along the inclination of the inclined long holes 130 and 131 according to the movement in the left to right direction of the link member 120. Therefore, the link member 120 also moves in the up to down direction while keeping the horizontal state according to the movement in the left to right direction of the link member 120.

More specifically, when the image forming apparatus 1 changes from the full-color printing mode to the monochrome printing mode, the link member 120 moves in the right direction and the upward direction with respect to the frame 110 while keeping the horizontal state. During the monochrome printing mode, the link member 120 keeps a position to which the link member 120 has moved (a first position) (FIG. 9A).

On the other hand, when the image forming apparatus 1 changes from the monochrome printing mode to the full-color printing mode, the link member 120 moves in the left direction and the downward direction with respect to the frame 110 while keeping the horizontal state. During the full-color printing mode, the link member 120 keeps a position to which the link member 120 has moved (a second position) (FIG. 9B).

In this embodiment, the three transfer rollers 13*a* to 13*c* for Y, M, and C are shifted in the up to down direction by moving the link member 120 between the first position (the monochrome printing mode) and the second position (the full-color printing mode). According to the movement of the link member 120 described above, an operation for lifting and inclining one end of the transfer belt 30 and, during the monochrome printing mode, separating the transfer belt 30 from the three photoconductive drums 10*a* to 10*c* for Y, M, and C is also performed.

This operation is explained in more detail with reference to FIGS. 10A and 10B.

In the full-color printing mode, as shown in FIG. 10B, the link member 120 is in the second position (the position moved to the left side and the lower side). At this point, the respective roller shafts 160*a* to 160*c* of the transfer rollers 13*a* to 13*c* for Y, M, and C penetrating through the through holes 122*a* to 122*c* are located on the right sides of the through holes 122*a* to 122*c*. Positions in the up to down direction of the respective contact surfaces 123*a*, 123*b*, and 123*c* of the through holes 122*a* to 122*c* are formed to be at the same height on the right sides of the respective through holes and formed to be at different heights depending on Y, M, and C on the left sides of the respective through holes.

When the link member 120 is in the second position, the roller shafts 160*a* to 160*c* for Y, M, and C supported by the contact surfaces 123*a*, 123*b*, and 123*c* on the right sides of the holes and the roller shaft of the transfer roller 13*d* for K are adjusted to coincide with each other in the up to down direction and become horizontal. The respective shafts of the transfer rollers 13*a* to 13*d* are urged to the lower side by the roller supporting units 150*a* to 150*d*. Therefore, in the full-color printing mode, the four transfer rollers 13*a* to 13*d* come into press contact with the four photoconductive drums 10*a* to 10*d* via the transfer belt 30.

The shape of the distal end contact surface 136 is formed such that a position of the lower surface of the lift roller 106, the link roller 106 being in contact with the distal end contact surface 136 of the link member 120, and a position of the lower surface of the fixed roller 103 adjacent to the transfer roller 13*d* for K are in the same positions each other in the up to down direction. Therefore, the transfer belt 30 is kept horizontal over a range from the transfer roller 13*a* for Y and the transfer roller 13*d* for K.

On the other hand, in the monochrome printing mode, as shown in FIG. 10A, the link member 120 moves from the second position to the first position (the position moved to the right side and the upper side with respect to the second position).

The lift roller 106 is urged upward by the not-shown elastic member as described above. Therefore, the lift roller 106 also shifts upward according to the upward movement of the link member 120. Since the step is formed in the distal end contact surface 136, positions in the up to down direction are different by an amount of the step in the first position and the second position. This results in that the lift roller 106 shifts upward by an amount obtained by adding the height of the step to an amount of the upward movement of the link member 120.

In the transfer belt 30, predetermined tension is maintained by the tension roller 105 (see FIG. 5, etc.). Therefore, one end of the transfer belt 30 is lifted by the upward movement of the lift roller 106. This causes the transfer belt 30 to be inclined between the lift roller 106 and the fixed roller 103 without loosening.

As a result, in the monochrome printing mode, the photoconductive drums 10*a* to 10*c* for Y, M, and C and the transfer belt 30 are separated and unnecessary abrasion is prevented. An amount of movement in the up to down direction of the lift roller 106 (an amount of lift of the transfer belt 30) is, for example, about 5 to 6 mm.

The transfer rollers 13*a* to 13*c* for Y, M, and C also shift upward, according to the upward movement of the link member 120. In the shifting motion of these transfer rollers 13*a* to 13*c*, this embodiment is characterized in that the transfer rollers 13*a* to 13*c* for Y, M, and C are not uniformly shifted by the same amount but are shifted such that separations D1 from the transfer belt 30 are substantially identical along the inclination of the transfer belt 30.

As described above, the positions in the up to down direction of the respective contact surfaces 123*a*, 123*b*, and 123*c* of the through holes 122*a* to 122*c* are at the same height on the right sides of the holes. However, steps of different heights are formed in the contact surface 123*a* for Y and the contact surface 123*b* for M such that positions are at different heights depending on Y, M, and C on the left sides of the holes.

When the image forming apparatus 1 changes from the full-color printing mode to the monochrome printing mode, the link member 120 moves to the right side. At this point, the roller shaft 160*a* for Y and the roller shaft 160*b* for M slide up the steps against an urging force applied downward and are fit in positions at heights different from each other. By adjusting sizes of the steps in advance, it is possible to set the separations D1 from the inclined transfer belt 30 to the respective transfer rollers 13*a* to 13*c* substantially identical. The separations D1 are slight distances of, for example, about 1 mm.

Figure 11A:
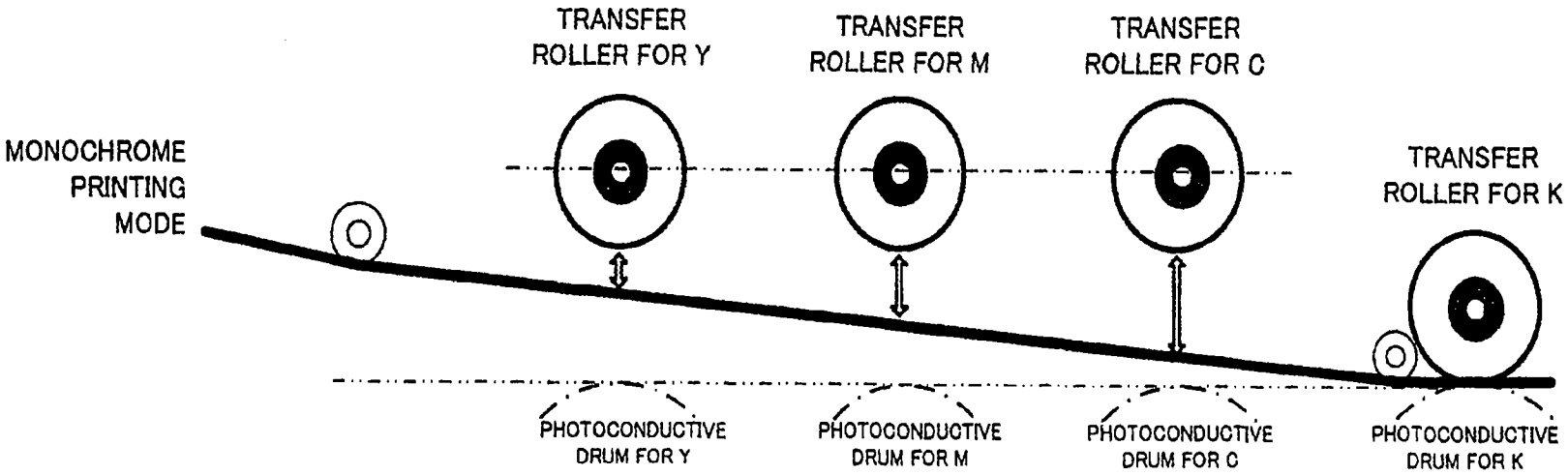
FIGS. 11A and 11B are explanatory diagrams of a moving operation for transfer rollers for Y, M, and C according to a related art.
Figure 11B:
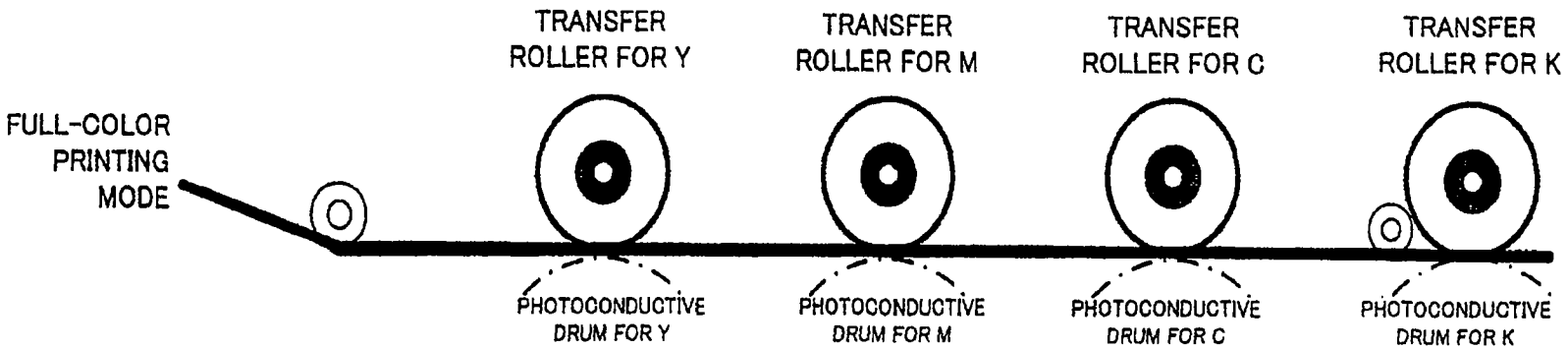

FIGS. 11A and 11B are diagrams showing a method of shifting transfer rollers disclosed in related arts such as JP-A 2004-163795 for comparison with this embodiment. A mechanism for shifting the transfer rollers is different from that of this embodiment. However, the separation of transfer rollers for Y, M, C from photoconductive drums and a transfer belt in the monochrome printing mode is disclosed in the related arts as well. The technique for inclining and lifting the transfer belt and separating the inclined belt from the photoconductive drums for Y, M, and C is also disclosed.

However, in all the related arts including JP-A2004-163795, as shown in FIG. 11A, the respective transfer rollers for Y, M, and C are uniformly shifted by the same amount. Therefore, when it is attempted to separate the transfer roller for Y from the transfer belt by a necessary amount, the transfer roller for M and the transfer roller for C are shifted a long distance more than necessary.

When the shifting distance of the transfer roller is long, longer time is necessary for switching the full-color printing mode and the monochrome printing mode. When it is attempted to reduce shifting time, a motor having large driving force is necessary. This leads to not only an increase in cost but also an increase in power consumption of the motor. Impact due to shift and stop of the transfer rollers also increases when the transfer rollers are sifted a long sifting distance in a short time. As a result, large noise may occur.

In contrast, in this embodiment, it is possible to set the separations D1 from the transfer belt 30 to the respective transfer rollers 13*a* to 13*c* to be substantially identical and reduce amounts of shift of the respective transfer rollers 13*a* to 13*c* to necessary minimum. Therefore, compared with the related arts, a total shifting distance (or an average shifting distance) of the transfer rollers 13*a* to 13*c* is small. Time for switching the full-color printing mode and the monochrome printing mode is reduced. Since the shifting distances are small, power consumption of the motor is reduced. Moreover, noise involved in the shift and stop is also reduced.

As explained above, with the image forming apparatus 1, the transfer unit 100, and the method of shifting transfer rollers according to this embodiment, it is possible to switch positions of the transfer rollers in the full-color printing mode and positions of the transfer rollers in the monochrome printing mode in a short time and reduce impact and noise involved in the switching of the positions.

The present invention is not limited to the embodiment per se. At an implementation stage, the elements can be modified and embodied without departing from the spirit of the present invention. Various embodiments of the invention of can be formed by appropriately combining plural elements disclosed in the respective embodiments. For example, several elements may be deleted from all the elements described in the embodiment. Moreover, elements descried in different embodiments may be appropriately combined.

What is claimed is:

1. An image forming apparatus comprising:

a first photoconductive member used during monochrome printing;

a second, a third and a fourth photoconductive members used together with the first photoconductive member during full-color printing, and arranged in parallel to the first photoconductive member;

a transfer belt, onto an outer peripheral surface of which a toner image formed on the first photoconductive member is transferred during the monochrome printing, and toner images formed on the respective first, second, third and fourth photoconductive members are transferred during the full-color printing;

a first, a second, a third and a fourth transfer rollers provided on an inner peripheral side of the transfer belt and respectively arranged in positions opposed to the first, second, third and fourth photoconductive members;

a link member that shifts, during the full-color printing, the second, third and fourth transfer rollers to positions where the second, third and fourth transfer rollers are brought into press contact with the respective second, third and fourth photoconductive members via the transfer belt, and shifts, during the monochrome printing, the second, third and fourth transfer rollers to positions where the respective second, third and fourth rollers are separated from an inner peripheral surface of the transfer belt, the link member having a distal end contact surface which has a lower step portion and a higher step portion on a lower surface thereof;

a lift roller that is urged in an upward direction to come into contact with the lower step portion or the higher step portion of the distal end contact surface, the second, third and fourth transfer rollers being arranged in order of second, third and fourth transfer rollers and between the lift roller and the first transfer roller; and a fixed roller arranged between the first and second transfer rollers.

2. The image forming apparatus of claim 1, wherein the lift roller moves upward while coming into contact with the higher step portion of the distal end contact surface during the monochrome printing, and the lift roller moves downward while coming into contact with the lower step portion of the distal end contact surface during the full-color printing.

3. The image forming apparatus of claim 2, wherein the lift roller moves upward and downward according to the movement of the link member.

4. The image forming apparatus of claim 3, wherein the transfer belt is inclined upward from the fixed roller to the lift roller during the monochrome printing, and the transfer belt is kept horizontal over a range from the first transfer roller to the lift roller during the full-color printing.

5. The image forming apparatus of claim 4, further comprising a tension roller that applies tension to the transfer belt to prevent the transfer roller from loosening during both the monochrome printing and the full-color printing.

6. The image forming apparatus of claim 3, wherein the link member moves to a first position during monochrome printing, and the link member moves in parallel to a second position which is lower than the first position and is shifted in a horizontal direction from the first position during the full-color printing.

7. The image forming apparatus of claim 6, wherein the lift roller comes into contact with the higher step portion of the distal end contact surface when the link member moves to the first position, and the lift roller comes into contact with the lower step portion when the link member moves to the second position.

8. The image forming apparatus of claim 6, further comprising a circular eccentric cam that is inserted in a cutout of the link member and has an eccentric shaft, wherein the link member moves in the horizontal direction by rotation of the circular eccentric cam around the eccentric shaft.

9. The image forming apparatus of claim 8, further comprising a link guide member, wherein the link guide member is inserted into an inclined long hole formed in the link member, and the link member moves further upward and downward by sliding of the link guide member along the inclination of the inclined long hole in accordance with the movement in the horizontal direction.

* * * * *